US006527493B1

(12) United States Patent
Kamphorst et al.

(10) Patent No.: US 6,527,493 B1
(45) Date of Patent: Mar. 4, 2003

(54) HANDLING OF TUBE SECTIONS IN A RIG FOR SUBSOIL DRILLING

(75) Inventors: Herman Kamphorst, Northorn (DE); Dietrich Böttger, Den Helder (NL); Gustaaf Louis van Wechem, Reeuwijk (NL)

(73) Assignee: Varco I/P, Inc., Orange, CA (US)

( * ) Notice: Subject to any disclaimer, the term of this patent is extended or adjusted under 35 U.S.C. 154(b) by 0 days.

(21) Appl. No.: 09/555,831

(22) PCT Filed: Dec. 5, 1997

(86) PCT No.: PCT/NL97/00667

§ 371 (c)(1),
(2), (4) Date: Jan. 8, 2001

(87) PCT Pub. No.: WO99/30000

PCT Pub. Date: Jun. 17, 1999

(51) Int. Cl.[7] ..... E21B 19/14
(52) U.S. Cl. ..... 414/22.57
(58) Field of Search ..... 175/85; 414/22.58, 414/22.57

(56) References Cited

U.S. PATENT DOCUMENTS

| | | | | |
|---|---|---|---|---|
| 3,706,347 A | | 12/1972 | Brown | |
| 3,766,991 A | | 10/1973 | Brown | |
| 3,780,883 A | | 12/1973 | Brown | |
| 3,915,244 A | * | 10/1975 | Brown | 175/85 |
| 4,274,778 A | * | 6/1981 | Putnam et al. | 414/22 |
| 4,403,897 A | | 9/1983 | Willis | |
| 5,036,927 A | | 8/1991 | Willis | |
| 5,107,940 A | * | 4/1992 | Berry | 175/85 |
| 6,276,450 B1 | * | 8/2001 | Seneviratne | 166/85.1 |

FOREIGN PATENT DOCUMENTS

| | | |
|---|---|---|
| EP | 0 285 385 A2 | 10/1988 |
| EP | 0 311 455 A1 | 4/1989 |
| WO | WO 92/11486 | 7/1992 |
| WO | WO 93/07358 | 4/1993 |
| WO | WO 96/18799 | 6/1996 |

* cited by examiner

*Primary Examiner*—Joseph E. Valenza
*Assistant Examiner*—Kenneth W. Bower
(74) *Attorney, Agent, or Firm*—Christie, Parker & Hale, LLP

(57) ABSTRACT

A drive unit (1) for a subsoil drilling rig comprises a drive unit (5), an engagement unit (12) for releasably engaging a tube section (13) extending therefrom in a drilling direction and a gripper (15) movable relative to the engagement unit (12) between a first position for gripping a tube engaged by the engagement unit (12) and a second position for gripping a tube section (13) in a transfer position. Supplied tube sections (13) can be handled reliably and movements of supplied tube section (13) can be controlled accurately. Co-ordination of positions and movements between the supplied tube sections (13) and the drive unit (1) is simplified. A drilling rig incorporating such a drive unit (1) and a method employing such a drive unit (1) are described as well.

15 Claims, 4 Drawing Sheets

HANDLING OF TUBE SECTIONS IN A RIG FOR SUBSOIL DRILLING

TECHNICAL FIELD

This invention relates to a drive unit, a drilling rig for subsoil drilling, and to a method of handling tube sections using such equipment. Handling of tube sections occurs, for example, in the course of placing and removing a casing in a bore hole in the lithosphere and in the course of drilling a bore hole and tripping (removing and/or reintroducing a string of joints into a bore hole).

BACKGROUND ART

Conventionally, handling of, for instance, casing sections in a rotary well drilling rig is carried out in the following manner. Starting from a situation in which a string of casing is suspended from a spider at the rig floor and extends downwards in a bore hole, a protecting and guiding device is mounted to the connector forming the top end of the casing string suspended from the spider. Then a next casing section is attached to a joint elevator, which is cable mounted to a drive unit, and hoisted into a vertical orientation freely suspended above the floor of the well head as the block carrying the drive unit is lifted. During lifting, the casing section is guided to prevent damage of the external, unprotected thread at its bottom end. A stabbing board is moved toward the tube string elevator mounted to the drive unit.

Subsequently, the block is slowly moved down and the thread at the bottom end of the section to be attached is guided by a roustabout into the casing connector at the top end of the string suspended from the bottom spider elevator. Then the protecting and guiding device is removed and the block moves down further until the casing section to be attached stands on thread on the string to which it is to be attached. Then a casing tong is moved into an operating position and the casing section is moved to and fro at its top end and rotated until the thread at its lower end and the thread at the top end of the casing string is projecting from the bore hole mate. This involves close cooperation of the person orienting the casing to be attached (the stabber) and the person operating the casing tong (also known as Weatherford tong).

After the connection between the casing section and the casing string has been made, the block moves down and the stabber guides the top end of the casing into the tube string elevator. Then the joint elevator is disengaged and the stabbing board is moved back into its parking position. Then the casing tongs are activated and the casing is rotated until the threads fully mate and the required make-up torque is reached. The casing tong is then moved back to its parking position.

If the casing string needs to be washed down, the block is lowered somewhat further, so that the top end of the newly attached case joint is introduced into a sealing for providing a sealed high pressure mud supply to the casing string (an example of such a coupling apparatus is described in international patent application WO 92/11486). Then the newly attached casing section is filled with mud or, if the casing needs to be washed down, mud at a pressure of up to about 60 bar is circulated down the casing to wash down the casing.

To lower the casing string with the newly attached casing section into the bore hole, the casing string is briefly lifted, which allows the spider to disengage, and the block carrying the drive unit from which the string is suspended is lowered to just above the floor. Finally, the spider engages the string again and the block is lowered a little more to allow the tube string elevator to disengage. Then the above cycle is repeated until the entire casing string in the well is completed.

The connection and disconnection between drill pipe sections and a drill pipe string in a bore hole involves a slightly different method of making up and breaking the connections and of suspending the string from the drive unit. However, irrespective of the type of tube sections which are connected or disconnected, these methods are cumbersome, time-consuming and laborious. A very important disadvantage of the laborious nature of these methods is that many persons have to be present in an area where there is a high risk of accidents in terms of falling objects, explosions and the like. Other problems include limited visibility of the upper end of a casing section as it is introduced in the tube string elevator.

In U.S. Pat. No. 3,766,991 a drive unit according to the introductory portion of claim 1 and a method according to the introductory portion of claim 13 are described. In the particular drive unit as described, the device for engaging the tube sections and the drive connected thereto are tiltable to allow the introduction of tube sections into the engaging unit from the side. This, however, entails the disadvantage of a complex and expensive construction of the drive unit, in particular if tube sections of sizes typically used as drill or casing tubes of an oil or gas well are to be handled, and requires a precise positioning of the tube section to be introduced from the side relative to the engagement unit of the drive unit which is suspended by cables, and a close coordination of the feeding of tube sections and the vertical movement of the drive unit. Such methods are inherently time-consuming, which has a negative effect on the productivity of a rig.

SUMMARY OF THE INVENTION

It is an object of the present invention to make handling of tube sections in a rig for subsoil drilling safer and more efficient without entailing the disadvantage of a complex and expensive construction of the drive unit.

According to the present invention, this object is achieved by providing a drive unit according to claim 1. Other embodiments of the invention are formed by a rig for subsoil drilling according to claim 10 and a method for handling tube sections in a rig for subsoil drilling according to claim 13.

By providing the drive unit with a gripper which is movable relative to the engagement unit of the drive unit between a first position for gripping a tube extending along the tube string axis and engaged by the engagement unit, and a second position for gripping a tube radially directed towards the tube string axis, supplied tube sections can be gripped and movements of supplied tube sections relative to the engagement unit in the drive unit can be guided and controlled accurately until the tube sections are engaged by the engagement unit. It is not necessary to tilt the engagement unit, and co-ordination of positions and movements between the supplied tube sections and the drive unit is simplified.

Particularly advantageous embodiments are described in the dependent claims. Further objects, embodiments and details of the present invention are set forth in the description below and the accompanying drawings.

MODES FOR CARRYING OUT THE INVENTION

Figure 1:
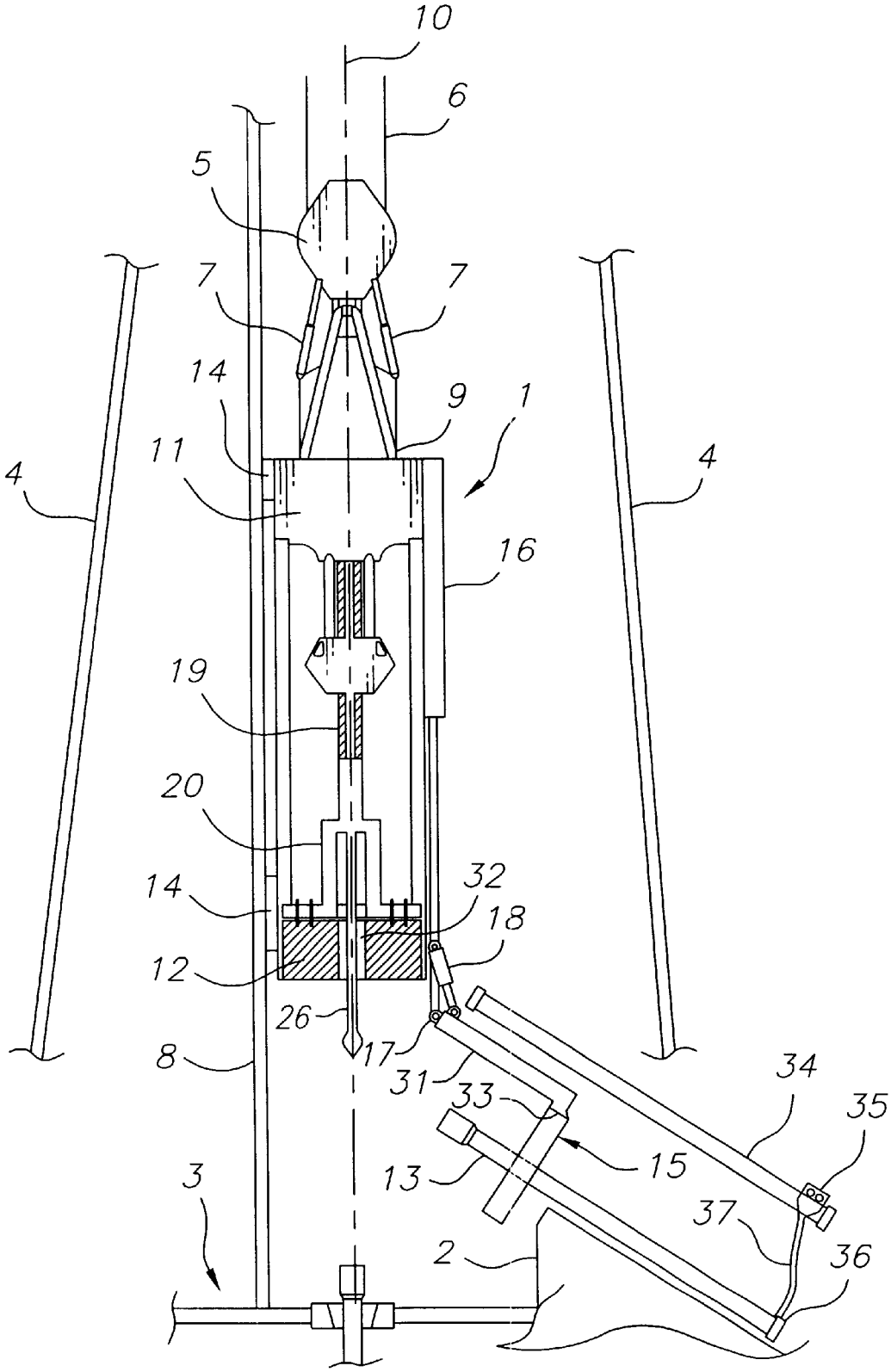
FIGS. 1–3 are schematic and partial side views of a drive unit and a tube transfer system of a drilling rig according to one embodiment of the present invention.
Figure 2:
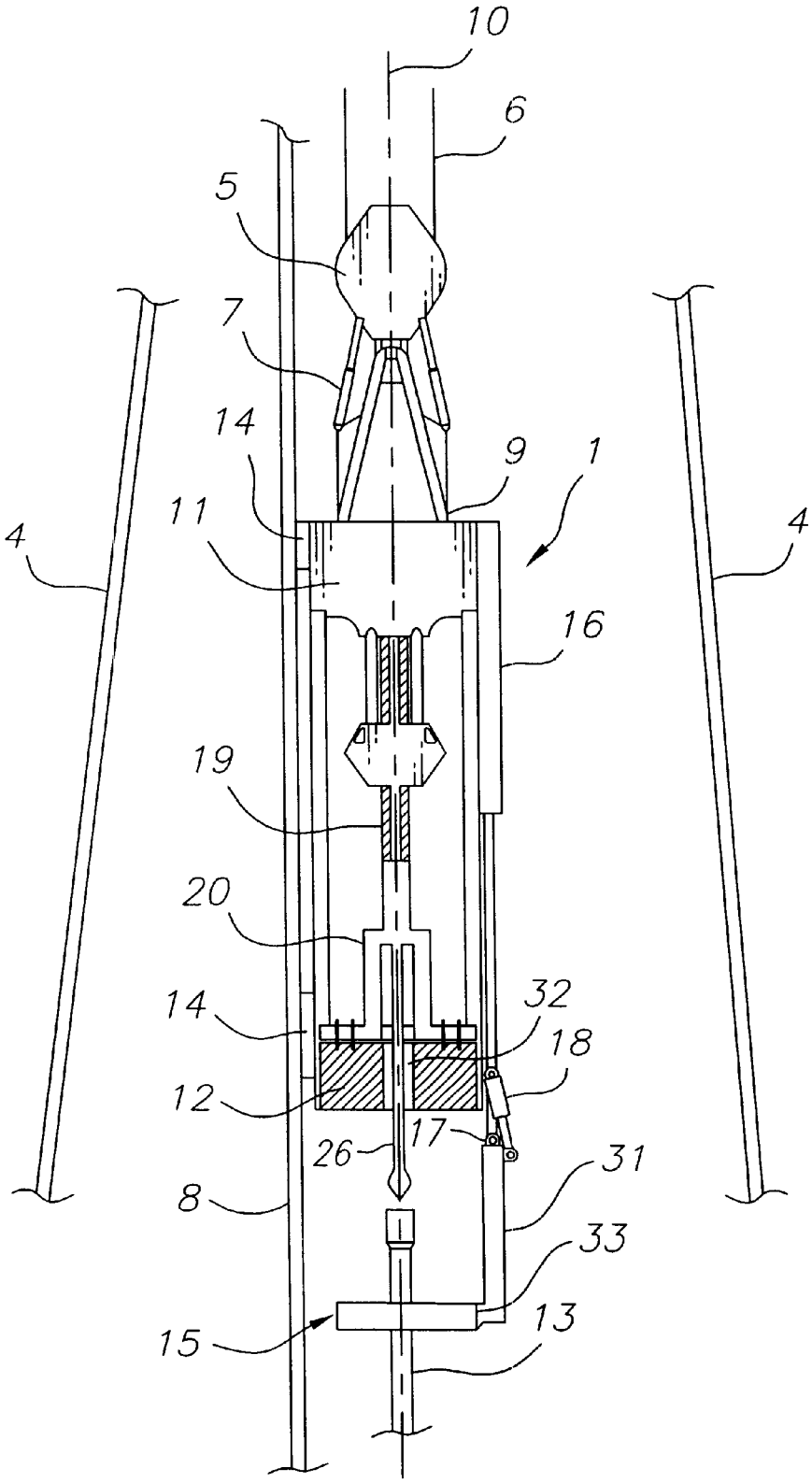
Figure 3:
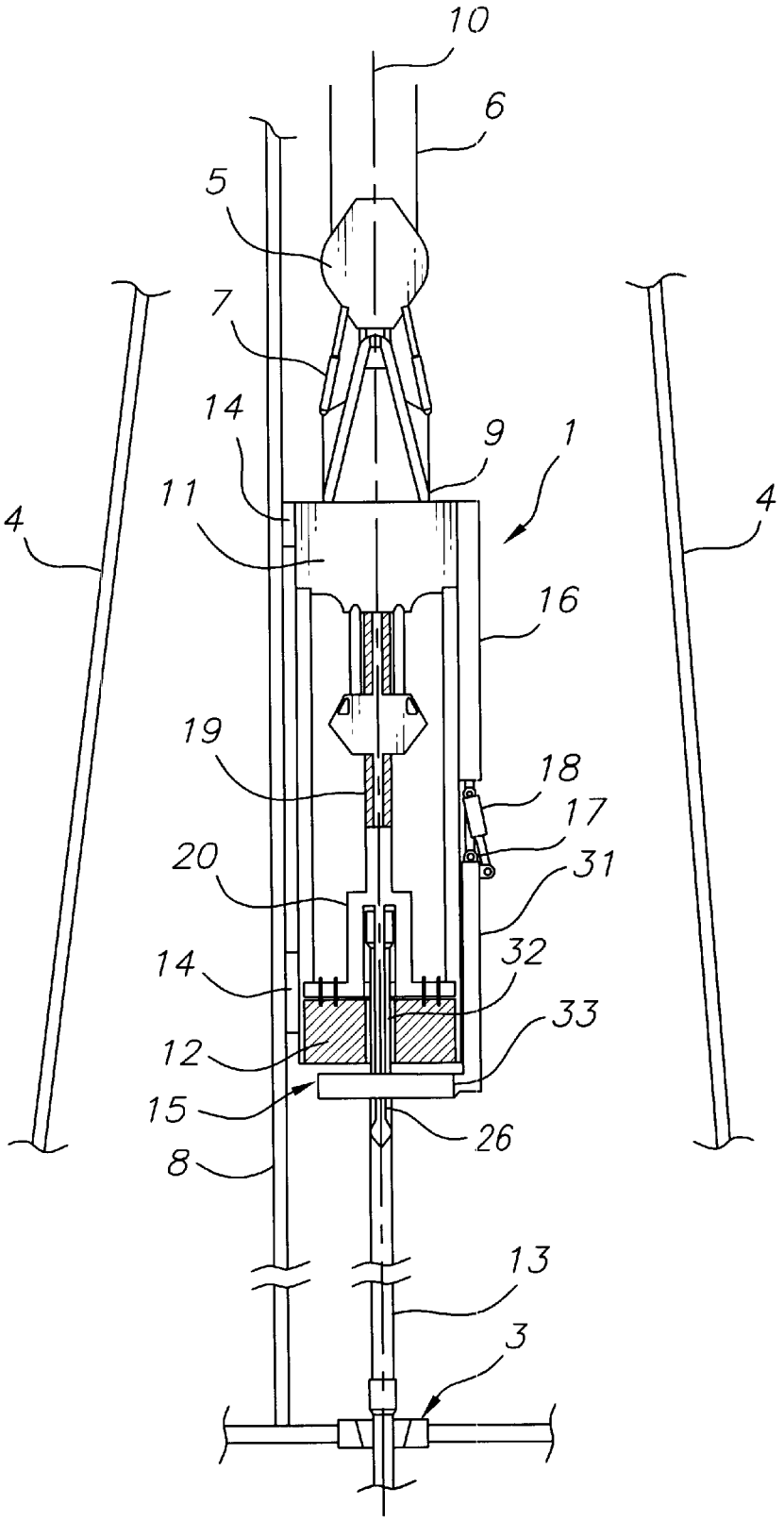

In FIGS. 1–3 a rotary well drilling rig with a drive unit 1, a tube section transfer device in the form of a ramp 2, a rig floor 3 and a portion of a support tower 4 are shown. The drive unit 1 is suspended from a hoisting block 5 carried by hoisting cables 6. Compensators 7 are provided between the block 5 and the drive unit 1 for controlling relative movements of the block 5 and the drive unit 1. A guide 8 is provided for guiding the drive unit 1.

Together with a suspension loop 9, the compensators 7 form a connecting structure connecting the rive unit 1 to the block 5 which can lift and lower the drive unit 1 along the guide 8. The drive unit 1 includes a motor unit 11 for driving rotation of a tube string suspended from the drive unit 1. It is observed that in the present example the tube string axis 10 and the guide 8 extend vertically. However, in some applications, such as the drilling of tunnels, the tube string axis and the guide may be in a slanting orientation or even extend in a horizontal plane.

Furthermore, various alternatives for lifting and lowering the drive unit can be provided. Instead of hoisting cables, for instance a hydraulic lifting structure can be provided to lift and lower the drive unit.

The example described relates to the handling of casing sections but, generally, it can also be applied to the handling of other tube sections, such as drill pipe sections. Each of the sections can, in principle, consist of one or more joints.

For engaging tube sections, the drive unit 1 includes an engagement unit 12 for releasably engaging a casing section 13 extending downwards therefrom along the tube string axis 10. In this example, the engagement unit 12 is provided in the form of a rotatable tube string elevator for retaining the casing section in axial direction and for exerting a torque about the axis 10 on the engaged casing section. To ensure that sufficient friction is provided between the tube string elevator and a casing section to transfer the make-up torque while only the casing section is suspended from the spider elevator, the tube string elevator is of the type adapted for actively inducing clamping forces between the claws of the spider elevator and the casing sections. Such clamping means are known in the art as a fixedly mounted part of the drive unit and therefore not described in further detail. Alternatively, the engagement unit can, for example, be provided with a conical thread adapted for engaging a conical thread of a drill pipe or other tube section to retain the tube section both axially and rotationally or with a tube string elevator and a wrench separate therefrom.

The drive unit 1 is further equipped with guide runners 14 for guiding the drive unit 1 along the guide 8.

In order to engage a casing section 13 radially fed towards the tube string axis 10 and lift the casing section 13 into a position suspended along that tube string axis 10, the proposed drive unit 1 is provided with a gripper 15. The gripper 15 is mounted to the drive unit 1 in movable relationship to the engagement unit 12 between a first position, shown in FIG. 3, for gripping a casing 13 extending along the tube string axis 10 and engaged in the engagement unit 12, and a second position, shown in FIG. 1, for gripping a casing section 13 projecting radially towards the tube string axis 10.

The ramp 2 is adapted for bringing tube sections 13 in a predetermined transfer position, shown in FIG. 1, corresponding to the second position of the gripper 15. Such ramps are also known in the art and therefore not described in further detail. In the present example, a guide rail 34 is arranged above the ramp 2. A runner 35 is movably mounted to the guide rail 34 to travel along the guide rail 34 and carries a tube section carrier 36 suspended from a cable or rod 37 attached to the runner 35. In operation, the rig shown operates as is described hereinafter for a single cycle of handling one casing section. First, a casing section 13 is brought in the transfer position shown in FIG. 1, in which position the casing section 13 is directed radially in the direction of the tube string axis 10. In this example, the casing section 13 is also directed upwards to reduce the angle over which the casing section is to be tilted to be oriented parallel to the tube string axis 10. The trailing end of the casing section 13 is held by the tube section carrier 36 suspended from the guide rail 34. The casing section 13 can be brought in the transfer position at any time prior to the moment at which it is to be gripped by the gripper 15 and after a previous casing section has been brought in line with the drive unit 1 and the bore hole axis 10.

The casing section 13 in the transfer position is gripped by the gripper 15, so that a connection to the drive unit 1 is established. It is noted that since the path of movement of the gripper 15 is accurately controlled, a precise control of the position where the gripper 15 grips the casing section 13 in a transfer position supported by the ramp is provided in a simple manner by accurately controlling the position in longitudinal direction of the casing section 13 in the transfer position supported by the ramp 2.

If casing sections of different lengths are to be installed in a random order or if tolerances of the length of the casings are relatively wide, it is advantageous if the gripper arm 31 or the ramp 2 is provided with a sensor for sensing the position of the front end of a casing section which is being fed to the transfer position.

Subsequently, the drive unit 1 is lifted, entraining the casing section 13, and the gripper 15 is moved from the second position gripping the casing section 13 in the transfer position to the first position gripping the casing section 13 in the position vertically suspended from the engagement unit 12 as shown in FIG. 3. While the drive unit 1 is lifted, the gripper 15 is entrained by the lifting drive unit 1, so that the main displacement of the gripper 15 along the tube string axis is obtained by travelling along with the rest of the drive unit 1. During this movement a major part of the weight of the casing section is carried by the tube section carrier 36, so that the moment the gripper 15 has to exert to perform the required movement is substantially reduced. Since the tube section carrier 36 is translatable along the guide rail 34 and freely pivotable, it does not interfere with the movement of the casing section determined by the gripper 15 but nevertheless supports the casing section 13 to assist the gripper 15.

The gripper 15 is actively controlled to move and guide the casing sections from the transfer position into engagement with the engagement unit 12, vertically suspending therefrom. Thus, the process of fetching and connecting a casing section 13 is substantially simplified and requires little or no manual labour in a hazardous area. Since the casing sections 13 are aligned and positioned relative to the engagement unit 12 by a gripping member 15 which forms part of the same drive unit 1 as the engagement unit 12, it is relatively easy to achieve an accurate axial positioning and alignment between the casing 13 and the engagement unit 12. Furthermore, requirements regarding the accuracy of the transfer position of the casing sections 13 (FIG. 1) are relatively low, because the final positioning and alignment can be provided by the gripper 15 of the drive unit 1.

The gripper 15 is translatable along the tube string axis 10 relative to the engagement unit 12 for moving a casing section along that tube string axis 10. This allows first moving the gripper 15 from the position gripping the casing section 13 in the transfer position (FIG. 1) to a position in line with and under the engagement unit 12 (FIG. 2) and subsequently moving the gripper 15 upward to a position in which the casing section 13 is engaged by the engagement unit 12 (FIG. 3). Apart from providing a simple form of movement which is simple to control, this also ensures that the casing sections 13 are accurately in line with the engagement unit 12 before being engaged thereby.

Figure 4:
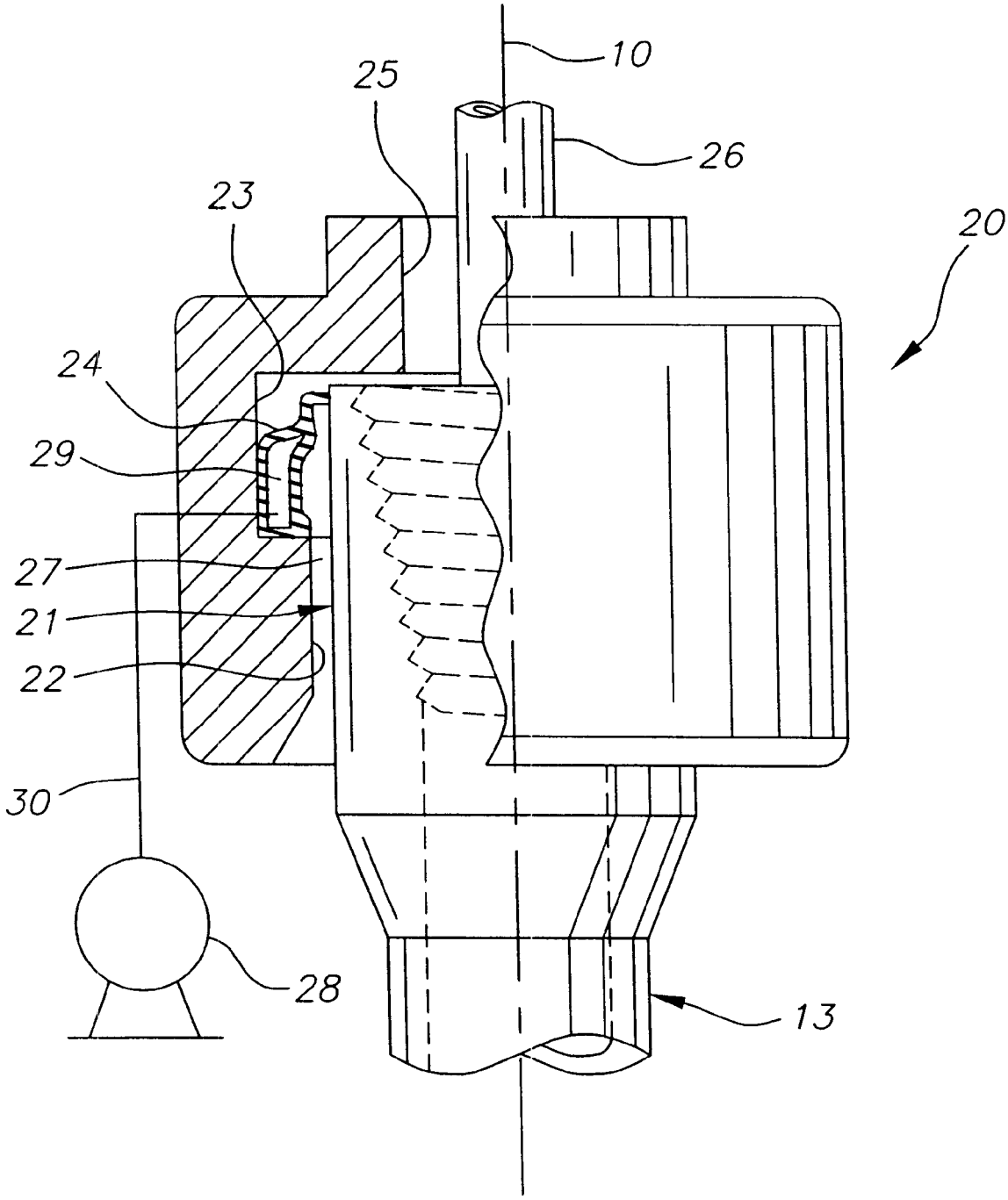
FIG. 4 is a partial cut-away side view of a circulation cap for sealing off a top end of a tube section.

Movement of the gripper 15 relative to the engagement unit 12 along the tube string axis 10 is achieved in a simple manner by an operating cylinder 16 parallel to the tube string axis. For driving pivotal movement of the gripper 15 about a hinge 17, a second operating cylinder 18 is provided. In order to avoid loading the cylinder 16 parallel to the tube string axis with transverse loads when a casing section is being lifted with the gripper in the position for gripping the casing section 13 in the transfer position shown in FIG. 1, a traveller (not shown) can be provided which guides the hinge 17 along the drive unit 1. Between the engagement unit 12 and the motor unit 11 a cross-over 19 is provided for transferring rotational movement about the drill string axis 10 imparted by the motor unit 11 to a circulation cap 20 which in turn carries the engagement unit 12. The circulation cap 20 is shown in more detail in FIG. 4.

The main purpose of the circulation cap 20 is to seal off a top end 21 of a casing section 13 engaged by the engagement unit 12. The circulation cap 20 according to the present example includes a cylindrical bore 22 with a circumferential recess 23 retaining a circumferential high pressure seal 24 and a passage 25 for feeding mud to the top casing section 13. In this example a mud filling tube 26 extends downward through the mud feeding passage 25. The circulation cap 20 is adapted to provide a venting passage 27 to vent the top end 21 of the casing section 13 in a first operating condition for normal filling of a newly connected casing section 13. The circumferential seal 24 is adapted to close off the venting passage 27 in a second operating condition for urging high pressure mud, for instance at a pressure of 40–75 bar, or higher, into the casing section 13.

It is noted that, in principle, instead of or in addition to the internally facing seal 24 also an externally facing seal can be provided in the circulation cap.

Compared with conventional drilling rigs in which the top end 21 of the topmost casing is clear under the cap in the first operating condition and in a higher position projecting into the circulation cap to engage the cap in the second operating condition, the cap 20 with a closable venting passage 27 provides the advantage that the casing sections 13 can always be engaged to the engaging unit 12 in the same position, independently of the need to subsequently wash down the casing string. In connection with the use of a movable gripper 15 to move the casing sections 13 into engagement with the engaging unit 12, this provides the advantage that the gripper can always be operated in the same manner to bring the casing section 13 into the same position before the engaging unit 12 engages the positioned casing section 13. This simplifies the control of the movement of the gripper. A general advantage, independent of the use of a movable gripper to bring tube sections into engagement with an engaging unit of the drive unit, of using a cap 20 with a closable venting unit is that the single engagement position of the casing sections allows the engaging unit to be more compact in axial direction which, in turn, allows lowering the casing string further down relative to the floor 3 of the rig. This facilitates work at the top end of a casing string suspending from the floor 3, since the top end will project less far above the floor 3.

The closable venting passage can be provided in many forms, for instance in the form of a separate passage in the cap with a valve in that passage. In the present example, in the first operating condition for filling the newly connected casing section with mud, the passage 27 for venting the top end 21 of the casing section 13 extends past the circumferential seal 24, more specifically between the circumferential seal 24 and the casing section 13. To be able to close the venting passage 27 the circumferential seal 24 is radially expandable, and a structure 28, 30 (schematically shown) for expanding the circumferential seal 24 is provided. The use of an expandable seal 24 provides the advantage that wear of the seal 24 is reduced because contact between the seal 24 and a casing section 13 occurs only if circulation of high pressure mud is required.

According to the present example, the circumferential seal 24 contains an inflatable chamber 29. The structure for expanding the circumferential seal 24 is formed by a compressor 28 and a channel 30 communicating with the chamber 29 for transferring a pressurized fluid to the chamber 29. By providing an inflatable seal as the expandable seal, the desired expandability is achieved in a simple manner with very few moving parts exposed to mud. The movability of the gripper can be controlled in many ways. As is shown in FIGS. 1–3, the gripper 15 is mounted to a manipulating arm 31, which allows accurate control of the pivoting and translating movement of the gripper 15 and forms a simple cost-effective construction.

Specifically for the handling of casing sections, which typically have fine threads at the ends thereof, the engagement unit 12 includes engagement surfaces 32 arranged around an opening coaxial with the tube string axis 10 for engagement of the outside of a casing section 13 and the engagement unit 12 is rotatably driven by the motor unit 11. By engaging the casing section 13 from the outside, the need of threaded engagement between fine threads of the drive unit 1 and the top end of each casing section 13 is avoided and by rotating the engagement unit 12, the connection between a casing unit to be connected and a casing string suspended from the rig floor 3 can be made without employing separate casing tongs, which have to be brought into an operating position and returned for each casing section 13 which is to be connected and disconnected. Furthermore, rotational movement about the drilling axis 10 which is imparted to the casing string by the drive unit 1 from which it is suspended is advantageous for facilitating further insertion of the casing string into the bore hole.

It is noted, however, that the use of a movable gripper 15 for bringing casing sections or other tube sections into engagement with the engaging unit is also advantageous if making up and breaking the connections between the casing sections and the string is carried out using conventional tongs.

The gripper 15 as shown has an entry 33 facing upwards if the gripper 15 is in the position shown in FIG. 1 for gripping a casing section projecting radially towards the tube string axis 10. This provides the advantage that a projecting end of a casing section 13 to be gripped can be entered into the gripper 13 without reversing upward movement of the gripper 15 entrained by the top lift unit 1.

The proposed drive unit and drilling rig are also advantageous for removing casing sections or drill pipe sections from a string in a bore hole. The operation then includes the steps of gripping a casing section 13 to be removed and released from the string in a position held by the engagement unit 12 and lowering the drive unit 1 and moving the gripper 15 until the casing section 13 is in the transfer position.

What is claimed is:

1. A drive unit for a subsoil drilling rig comprising:

a connecting structure for connection to a lifting means for lifting the drive unit;

a motor unit for driving rotation of a connected tube section extending along a tube string axis;

an engagement unit for releasably engaging a tube section extending along said tube string axis; and guide runner means for guiding the drive unit along a guide;

the drive unit being adapted for engaging a tube section radially directed towards said tube string axis and lifting said tube section into position extending along said tube string axis;

characterized by:

a gripper, guide means for guiding movements of said gripper relative to said engagement unit and drive means for driving movements of said gripper relative to said engagement unit, said guide means and said drive means being adapted for moving said gripper between a first position for gripping a tube section extending along said tube string axis and engaged by said engagement unit and a second position for gripping a tube section radially directed towards said tube string axis.

2. A drive unit according to claim 1, wherein said gripper is mounted to a pivotable manipulating arm.

3. A drive unit according to claim 1, wherein said gripper has an entry facing away from the drilling direction if said gripper is in said position for gripping a tube section projecting radially towards said tube string axis.

4. A subsoil drilling rig comprising a drive unit according to claim 1, a tube section transfer device for bringing tube sections in a predetermined transfer position corresponding to said second position of said gripper, and a guide for guiding the drive unit along the tube string axis.

5. A subsoil drilling rig comprising a drive unit according to claim 1, a tube section transfer device for bringing tube sections in a predetermined transfer position corresponding to said second position of said gripper, and a guide for guiding the drive unit along the tube string axis, wherein said transfer device includes a pivotably suspended tube section carrier.

6. A drilling rig according to claim 5, wherein said transfer device further includes a linear guide oriented radially relative to said tube string axis, said tube section carrier being guided along said guide.

7. A drive unit for a subsoil drilling rig comprising:

a connecting structure for connection to a lifting means for lifting the drive unit;

a motor unit for driving rotation of a connected tube section extending along a tube string axis;

an engagement unit for releasably engaging a tube section extending along said tube string axis;

guide runner means for guiding the drive unit along a guide;

the drive unit being adapted for engaging a tube section radially directed towards said tube string axis and lifting said tube section into position extending along said tube string axis;

characterized by:

a gripper, guide means for guiding movements of said gripper relative to said engagement unit and drive means for driving movements of said gripper relative to said engagement unit, said guide means and said drive means being adapted for moving said gripper between a first position for gripping a tube section extending along said tube string axis and engaged by said engagement unit and a second position for gripping a tube section radially directed towards said tube string axis;

wherein the gripper is translatable along said tube string axis relative to the engagement unit for moving a tube section along said tube string axis.

8. A drive unit according to claim 7, further including an operating cylinder extending in the direction of the tube string axis for driving movement of said gripper parallel to said tube string axis.

9. A drive unit for a subsoil drilling rig comprising:

a connecting structure for connection to a lifting means for lifting the drive unit;

a motor unit for driving rotation of a connected tube section extending along a tube string axis;

an engagement unit for releasably engaging a tube section extending along said tube string axis;

guide runner means for guiding the drive unit along a guide;

the drive unit being adapted for engaging a tube section radially directed towards said tube string axis and lifting said tube section into position extending along said tube string axis;

characterized by:

a gripper, guide means for guiding movements of said gripper relative to said engagement unit and drive means for driving movements of said gripper relative to said engagement unit, said guide means and said drive means being adapted for moving said gripper between a first position for gripping a tube section extending along said tube string axis and engaged by said engagement unit and a second position for gripping a tube section radially directed towards said tube string axis;

further including a circulation cap for sealing off a proximal end of a tube section engaged by said engagement unit, said circulation cap including a circumferential high pressure seal and a passage for feeding mud to the proximal tube section sealed off by said circulation cap, said circulation cap being adapted to provide a venting passage to vent said top end of said tube section in a first operating condition and to close off said venting passage in a second operating condition.

10. A drive unit according to claim 9, wherein, in said first operating condition, said passage for venting said top end of said tube section extends past said circumferential seal and wherein said means for closing said venting passage include said circumferential seal which is expandable and means for expanding said circumferential seal.

11. A drive unit according to claim 10, wherein said circumferential seal contains an inflatable chamber and wherein said means for expanding said circumferential seal are formed by a pressure source and a channel connecting said pressure source to said chamber for transferring a pressurized fluid to said chamber.

12. A drive unit for a subsoil drilling rig comprising:

a connecting structure for connection to a lifting means for lifting the drive unit;

a motor unit for driving rotation of a connected tube section extending along a tube string axis;

an engagement unit for releasably engaging a tube section extending along said tube string axis;

guide runner means for guiding the drive unit along a guide;

the drive unit being adapted for engaging a tube section radially directed towards said tube string axis and lifting said tube section into position extending along said tube string axis;

characterized by:

a gripper, guide means for guiding movements of said gripper relative to said engagement unit and drive means for driving movements of said gripper relative to said engagement unit, said guide means and said drive means being adapted for moving said gripper between a first position for gripping a tube section extending along said tube string axis and engaged by said engagement unit and a second position for gripping a tube section radially directed towards said tube string axis;

wherein said engagement unit includes engagement surfaces arranged around an opening coaxial with said tube string axis for engagement to the outside of a tube section and wherein said engagement unit is rotatably driveable.

13. A method for handling tube sections in a subsoil drilling rig including a drive unit for driving rotation of a tube section engaged by an engagement unit of the drive unit in an orientation extending along a tube string axis in a drilling direction comprising, for handling each tube section, the steps of:

providing the tube section in a transfer position directed radially towards said tube string axis;

gripping the tube section in said transfer position;

moving said drive unit opposite said drilling direction while entraining the tube section until said tube section is held by said drive unit in a position coaxial with said tube string axis;

characterized in that:

the tube section is engaged by a gripper of said drive unit in movable relationship to said engagement unit; and said gripper is moved and guided from a position gripping said tube section in said transfer position to a position gripping the tube section in a position in which the casing section is engaged by the engagement unit and extends coaxial with said tube string axis, said gripper also being entrained by said drive unit moving opposite said drilling direction.

14. A method for handling tube sections in a subsoil drilling rig including a drive unit for driving rotation of a tube section engaged by an engagement unit of the drive unit in an orientation extending along a tube string axis in a drilling direction comprising, for handling each tube section, the steps of:

providing the tube section in a transfer position directed radially towards said tube string axis;

gripping the tube section in said transfer position;

moving said drive unit opposite said drilling direction while entraining the tube section until said tube section is held by said drive unit in a position coaxial with said tube string axis;

characterized in that:

the tube section is engaged by a gripper of said drive unit in movable relationship to said engagement unit; and said gripper is moved and guided from a position gripping said tube section in said transfer position to a position gripping the tube section in a position in which the casing section is engaged by the engagement unit and extends coaxial with said tube string axis, said gripper also being entrained by said drive unit moving opposite said drilling direction;

wherein said gripper is first moved from said position gripping said tube section in said transfer position to a position gripping said tube section in a position in line with said tube string axis and wherein said gripper is moved upward to said position in which the tube section is engaged by said engagement unit of said drive unit.

15. A method for handling tube sections in a subsoil drilling rig including a drive unit for driving rotation of a tube section engaged by an engagement unit of the drive unit in an orientation extending along a tube string axis in a drilling direction comprising, for handling each tube section, the steps of:

providing the tube section in a transfer position directed radially towards said tube string axis;

gripping the tube section in said transfer position;

moving said drive unit opposite said drilling direction while entraining the tube section until said tube section is held by said drive unit in a position coaxial with said tube string axis;

characterized in that:

the tube section is engaged by a gripper of said drive unit in movable relationship to said engagement unit; and said gripper is moved and guided from a position gripping said tube section in said transfer position to a position gripping the tube section in a position in which the casing section is engaged by the engagement unit and extends coaxial with said tube string axis, said gripper also being entrained by said drive unit moving opposite said drilling direction;

further comprising, for removing a tube section from a string, the steps of:

gripping said tube section in a position extending coaxial with said tube string axis; and lowering said drive unit and moving said gripper until said tube section is in said transfer position.

* * * * *